US010104463B2

(12) United States Patent
Kim et al.

(10) Patent No.: US 10,104,463 B2
(45) Date of Patent: Oct. 16, 2018

(54) WIRELESS SOUND EQUIPMENT

(71) Applicant: LG Electronics Inc., Seoul (KR)

(72) Inventors: Donghan Kim, Seoul (KR); Jihye Choe, Seoul (KR); Jihye Kim, Seoul (KR); Kyoungsu Nam, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/655,499

(22) Filed: Jul. 20, 2017

(65) Prior Publication Data

US 2018/0184191 A1 Jun. 28, 2018

(30) Foreign Application Priority Data

Dec. 26, 2016 (KR) ..... 10-2016-0179010

(51) Int. Cl.
*H04R 1/10* (2006.01)

(52) U.S. Cl.
CPC ..... *H04R 1/1041* (2013.01); *H04R 1/105* (2013.01); *H04R 1/1016* (2013.01); *H04R 1/1025* (2013.01); *H04R 1/1091* (2013.01); *H04R 2201/107* (2013.01); *H04R 2201/109* (2013.01); *H04R 2420/07* (2013.01)

(58) Field of Classification Search
CPC .. H04R 5/033; H04R 2420/07; H04R 1/1041; H04R 1/1016; H04R 1/1058; G02C 11/06
USPC ... 381/23.1, 72, 74, 328, 330, 332, 380, 381
See application file for complete search history.

(56) References Cited

U.S. PATENT DOCUMENTS

2007/0159401 A1* 7/2007 Baliarda ..... H01Q 1/241 343/702
2008/0166907 A1* 7/2008 Sanford ..... H01R 43/24 439/345
2015/0200558 A1 7/2015 Castillo et al.
(Continued)

FOREIGN PATENT DOCUMENTS

KR 10-2007-0109323 A 11/2007
KR 20-2009-0001130 U 2/2009
(Continued)

OTHER PUBLICATIONS

Mazda, Mazda6—Body and accessories, 2014.*

*Primary Examiner* — William A Jerez Lora
(74) *Attorney, Agent, or Firm* — Birch, Stewart, Kolasch & Birch, LLP

(57) ABSTRACT

A wireless sound equipment includes a cradle including a pair of earbuds and a pair of holders having the earbuds coupled thereto. Each earbud includes an ear housing; a sound passage extended from a first surface of the ear housing; a sound output unit outputting sound via the sound passage; a wireless communication unit located in the ear housing; an earbud controller driving the sound output unit based on a signal transmitted by using the wireless communication unit; a main battery supplying an electric power; a plurality of earbud terminals exposed to the first surface of the ear housing and connected with the earbud controller; and a control button located in a second surface of the ear housing. The cradle also includes a cradle case in which the holders are formed; a plurality of cradle terminals provided in the holder and configured to contact with the earbud terminals; a sub battery located in the cradle case; and a cradle controller.

19 Claims, 12 Drawing Sheets

(56) References Cited

U.S. PATENT DOCUMENTS

| | | | | |
|---|---|---|---|---|
| 2015/0245125 | A1* | 8/2015 | Shaffer | H04R 1/1025 381/74 |
| 2016/0073188 | A1* | 3/2016 | Linden | H04R 1/1025 381/309 |
| 2017/0064433 | A1* | 3/2017 | Hirsch | H04R 1/1041 |
| 2017/0163784 | A1* | 6/2017 | Frazier Fields | H04M 1/72527 |

FOREIGN PATENT DOCUMENTS

| | | | |
|---|---|---|---|
| KR | 101438361 | * | 1/2014 |
| KR | 10-2015-0003555 | A | 1/2015 |
| KR | 10-2018-0103779 | A | 9/2016 |

* cited by examiner

FIG. 9

| As-Is | | To-Be | | |
|---|---|---|---|---|
| Cradle state | Earbud state | Couple Earbud to Holder | Convert switch state into the reverse in a state Earbud is coupled to Holder | Decouple Earbud from Holder |
| On | On | On | Off | On |
| | Off | On | Off[1] | On[1] |
| Off | On | Off | N/A[2] | N/A[2] |
| | Off | Off | On | On |
| | Note | Earbud ON/OFF depends on Cradle ON/OFF, Unless connected with External terminal for a preset time period, Earbud is switched OFF | | Earbud is unconditionally ON |

1. Earbud is decoupled in OFF state, when it is not paired for 3 minutes after switched ON
2. ON/OFF state of Earbud depends on ON/OFF state of Neckband and it will not happen the case where Earbud coupled to OFF-stated Neckband is ON-stated.

FIG. 10
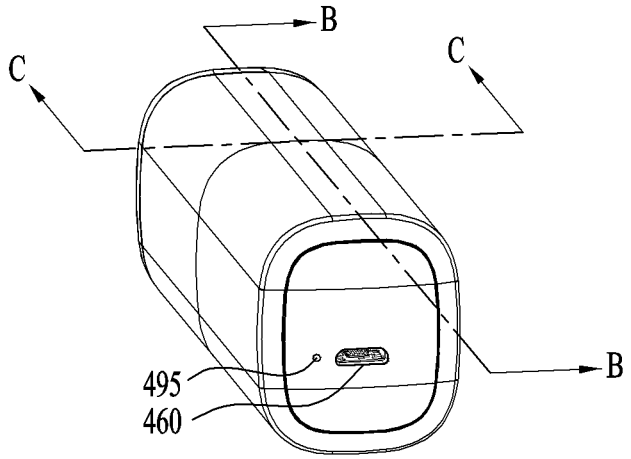
(a)
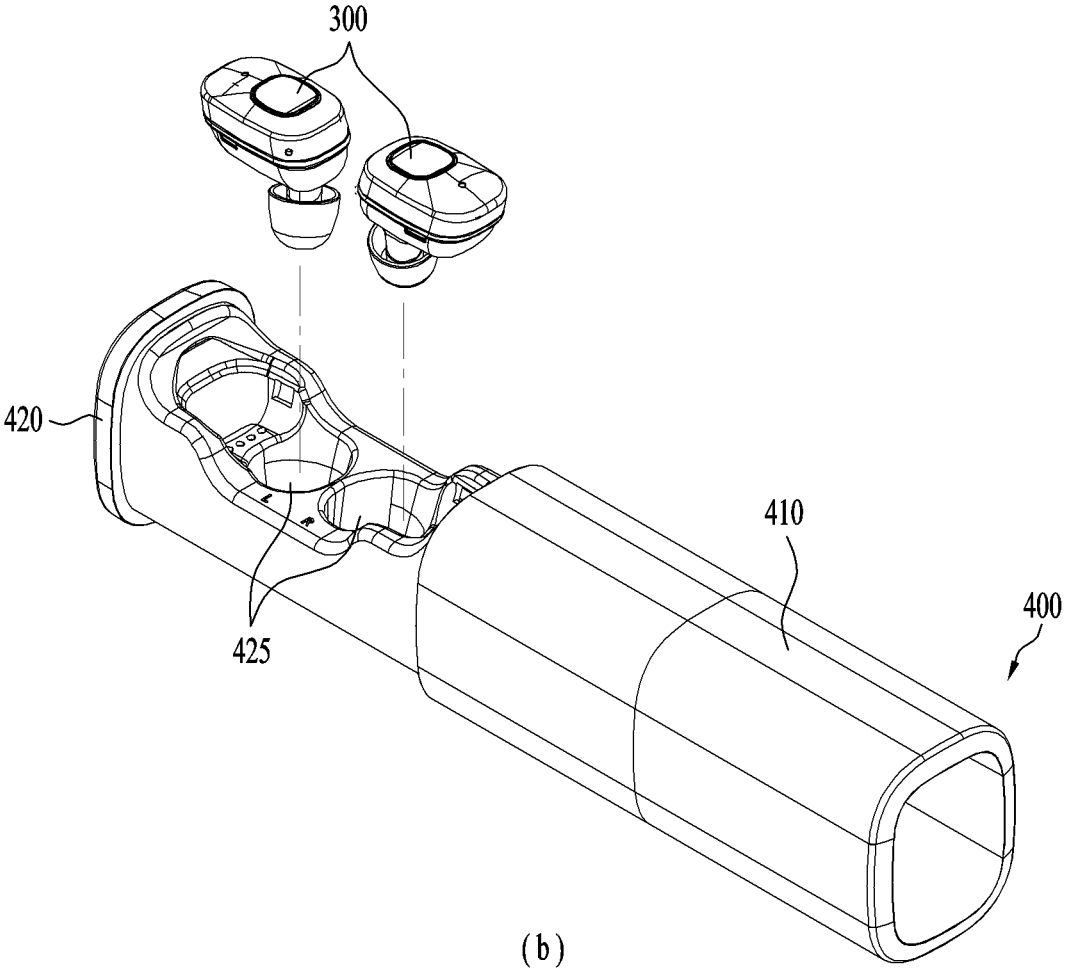
(b)

FIG. 12
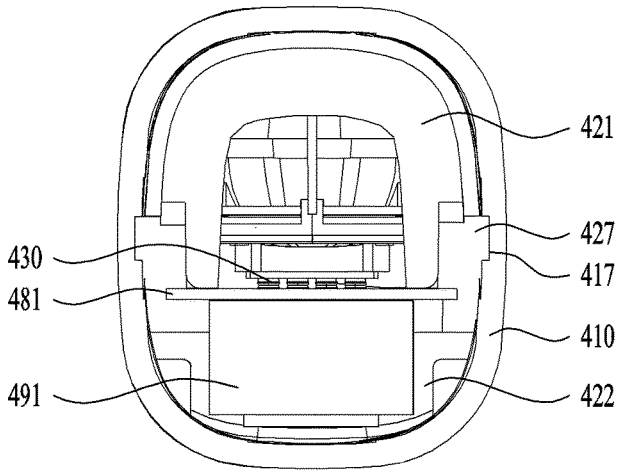
(a)
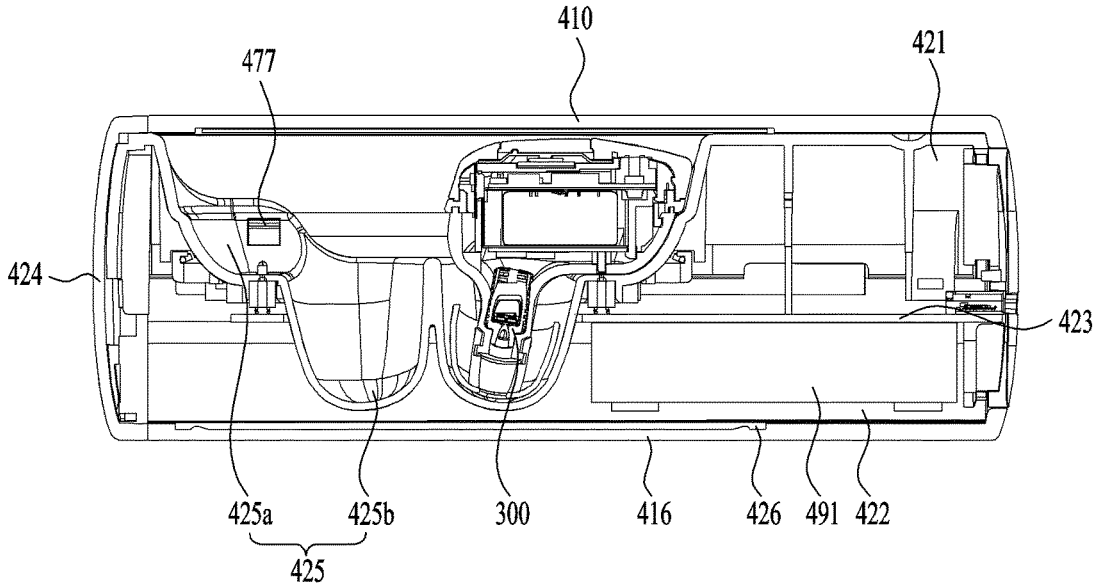
(b)

WIRELESS SOUND EQUIPMENT

CROSS-REFERENCE TO RELATED APPLICATIONS

Pursuant to 35 U.S.C. § 119(a), this application claims priority to Korean Patent Application No. 10-2016-0179010 filed on Dec. 26, 2016, the entire content of which is hereby incorporated by reference in its entirety.

BACKGROUND OF THE DISCLOSURE

Field of the Disclosure

Embodiments of the present disclosure relate to wireless sound equipment which receives a sound signal from a terminal and transmits a control signal for controlling the terminal by wireless communication with the terminal.

Background of the Disclosure

Sound equipment means the audio device which is able to receive a sound signal from a terminal and transmit the audio information collected via a microphone to the terminal. Typically, the wire type portable sound equipment is commonly used and it is connected to an ear jack of a terminal to receive a sound signal. In recent times, there are increasing demands for the wireless communication type wireless sound equipment in aspects of mobility and user convenience.

The wireless sound equipment having a design considering mobility is under development and examples of the wireless sound equipment having such the design include band-shaped headphone type wireless sound equipment, ear wearable type wireless sound equipment and ear inserting type wireless sound equipment. The band-shaped headphone type is worn on a user's head and facilitates the user's carrying. The band-shaped headphone type is worn on a user's head and facilitates the user's carrying. The wireless sound equipment facilitates music appreciation and the wearable wireless sound equipment is able to be worn on the user's body, only to enhance portability.

SUMMARY OF THE DISCLOSURE

Accordingly, an object of the present invention is to address the above-noted and other problems and provide the portable sound equipment including wireless earbuds with no sound cable.

Embodiments of the present disclosure may also provide a wireless sound equipment comprising a cradle comprising a pair of earbuds; and a pair of holders having the earbuds coupled thereto, wherein the earbud comprises an ear housing; a sound passage extended from a first surface of the ear housing; a sound output unit outputting sound via the sound passage; a wireless communication unit located in the ear housing; an earbud controller driving the sound output unit based on a signal transmitted by using the wireless communication unit; a main battery supplying an electric power; a plurality of earbud terminals exposed to the first surface of the ear housing and connected with the earbud controller; and a control button located in a second surface of the ear housing, and the cradle comprises a cradle case in which the holders are formed; a plurality of cradle terminals provided in the holder and configured to contact with the earbud terminals; a sub battery located in the cradle case; and a cradle controller.

The holder may comprise a magnet, and the earbud may comprise a hall sensor for sensing the magnet, and when the hall sensor senses the magnet, the earbud controller may transmit a control signal for ending the playing music or the connected call to an external terminal connected by the wireless communication unit.

The earbud controller may comprise a first circuit board arranged adjacent to the first surface of the ear housing and in which the sound output unit and the earbud terminals are mounted; a second circuit board arranged adjacent to the second surface of the ear housing and in which a dome switch become pressable when the control button is pressed; and a flexible circuit board connecting the first circuit board and the second circuit board with each other, and the main battery is arranged between the first circuit board and the second circuit board.

The ear housing may have a longitudinal shape with a longer vertical length, and the sound passage may be biased toward a lower portion of the ear housing and inclinedly projected in a first direction leftward or rightward with respect to a vertical direction of the first surface of the ear housing, and an antenna radiator may be further provided in an upper portion of the ear housing.

A portion may be omitted in the antenna radiator in the reverse direction of the first direction in which the sound passage is inclined.

The wireless sound equipment may further comprise a first microphone arranged in a lower corner of the ear housing in the first direction.

The wireless sound equipment may further comprise a second microphone arranged over the second surface of the ear housing, not overlapped with the antenna radiator.

The pair of the earbuds may comprise a master earbud connected with an external terminal and transceiving data; and a slave earbud receiving the data from the master earbud.

The cradle case may have a C-shaped curve to be wearable on the user's neck, and the holders may be arranged in ends of the C-shaped curve formed in the cradle case.

The holder may comprise a first accommodating portion accommodating the ear housing; and a second accommodating portion accommodating the sound passage by becoming recessed more than the first accommodating portion.

The second accommodating portion may be partially omitted.

The wireless sound equipment may further comprise a hook projection coupled to the earbud; and a hook lever comprising a hook button pressed by the user to decouple the hook projection from the earbud.

The cradle may further comprise a cover case covering the holder of the cradle case and formed in a cylindrical shape to be slidingly coupled to the cradle case.

The cradle terminal may comprise a first cradle terminal transmitting the electric power of the sub battery to the main battery of the earbud; and a second cradle terminal sensing whether the earbud is coupled, and the cradle controller may supply the electric power of the sub battery to the main battery via the first cradle terminal, when the second cradle terminal senses the coupling of the earbud.

The second cradle terminal may transmit information about an event received via the wireless communication unit of the earbud, and the cradle may notify a user of the event information.

The cradle may further comprise a switch; and a third cradle terminal transmitting a state of the switch to the earbud, and when the earbud is coupled to the holder, the earbud controller may convert the ON/OFF state of the earbud according to the ON/OFF state of the switch.

The earbud controller may convert a power state of the earbud, when sensing the conversion of the ON/OFF state of the switch via the third cradle terminal in a state where the earbud is coupled to the holder.

The cradle may further comprise a charging connector, and when supplied the electric power via the charging connector, the cradle may switch off the power of the earbud, and when the power supplied via the charging connector is stopped, the cradle may convert the ON/OFF state of the earbud according to the ON/OFF state of the switch.

The earbud controller may convert the power state of the earbud into an ON state, when the earbud is decoupled from the holder.

The earbud controller may switch off the power of the earbud, when the wireless communication unit is not connected with an external terminal for a preset time period or more.

According to the embodiments of the present disclosure, the wireless sound equipment in accordance with the present disclosure may include no sound cable only to solve the disadvantage of the uncomfortableness the user feels when a sound cable is stuck in the clothes Furthermore, the wireless sound equipment may allow the user to rest the earbuds on the cradle wearable on the neck and promote portability and convenience.

Still further, the cradle of the wireless sound equipment may notify the user of event generation such as call receiving, even when the user is not wearing the earbuds.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 9 is a diagram to describe power ON/OFF relation between the earbud and a cradle provided in the wireless sound equipment;

FIG. 10 is a diagram illustrating a cradle and an earbud which are provided in another example of a wireless sound equipment;

FIG. 12 is a sectional diagram the cradle of FIG. 10.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
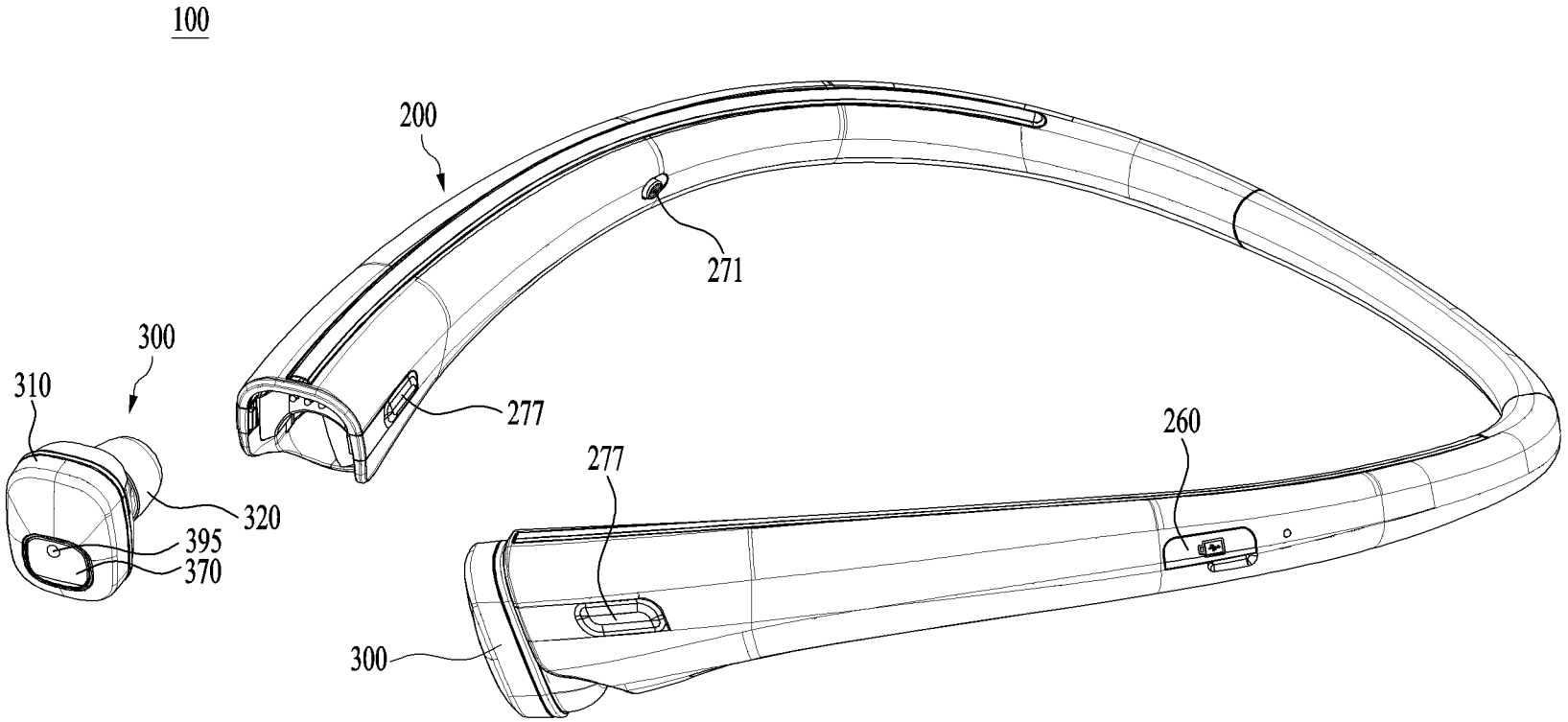
FIG. 1 is a perspective diagram illustrating one example of a wireless sound equipment, viewed in one direction.

FIG. 1 is a perspective diagram illustrating one example of a wireless sound equipment 100, viewed in one direction. The wireless sound equipment 100 includes an earbud 300 connected to an external terminal and configured to transceiver a signal; and a cradle 200 for holding the earbud 300.

A conventional wireless sound equipment typically includes only an ear-inserting structure so that the user has to wear the wireless sound equipment all the time even if not using or happens not to use it once putting it in a bag or pocket. Also, the conventional wireless sound equipment is small-sized and has a short usage time inconveniently.

A neckband type wireless sound equipment may include a main body wearable on the neck and configured to transceiver a signal with an external terminal by wireless communication; and an earbud connected with the main body via sound cable to receive a signal from the main body. In this instance, the sound cable causes a tangle in the user's scarf or muffler.

To solve the disadvantages of the conventional wireless sound equipment wearable on the ear or the neckband type wireless sound equipment, the present disclosure provides the wireless sound equipment 100 including a wireless earbud 300 insertable in the ear; and a wearable cradle 200 in which the earbud 300 is rested.

The cradle 200 has a C-shaped curve and is wearable on the user's neck. To make the user wear the cradle 200, a middle portion of the cradle 200 which is located on a back side of the user's neck may be made of an elastic material and both end portions of the cradle 200 are made of a hard material such as plastic. A holder 225 may be provided in each of the end portions of the cradle 200 to seat the earbud 300. It is not necessary to locate the holder 225 in the end portion of the cradle 200. As occasion demands, the holder could be located in the middle portion of the C-shaped curve.

Different from the conventional neckband type wireless sound equipment 100, the cradle 200 provided in the wireless sound equipment includes no wireless communication unit connected to an external terminal and only the earbud 300 is able to receive a sound signal from the external terminal.

The cradle 200 in accordance with the present disclosure functions as a portable battery for charging the holder 225 for resting the earbud 300 and the earbud and also performs a preset alarm function unless the user wears the earbud 300.

The earbud 300 in accordance with the present disclosure is detachable from the holder 225 of the cradle 200 and a pair of earbuds 200 may be provided to be worn on the light and left ears. The earbud 300 includes an ear housing 310 for mounting components and an ear tip 320 projected from the ear housing 310. The pair of the earbuds 300 may be similar to each other, except partial differences.

Figure 2:
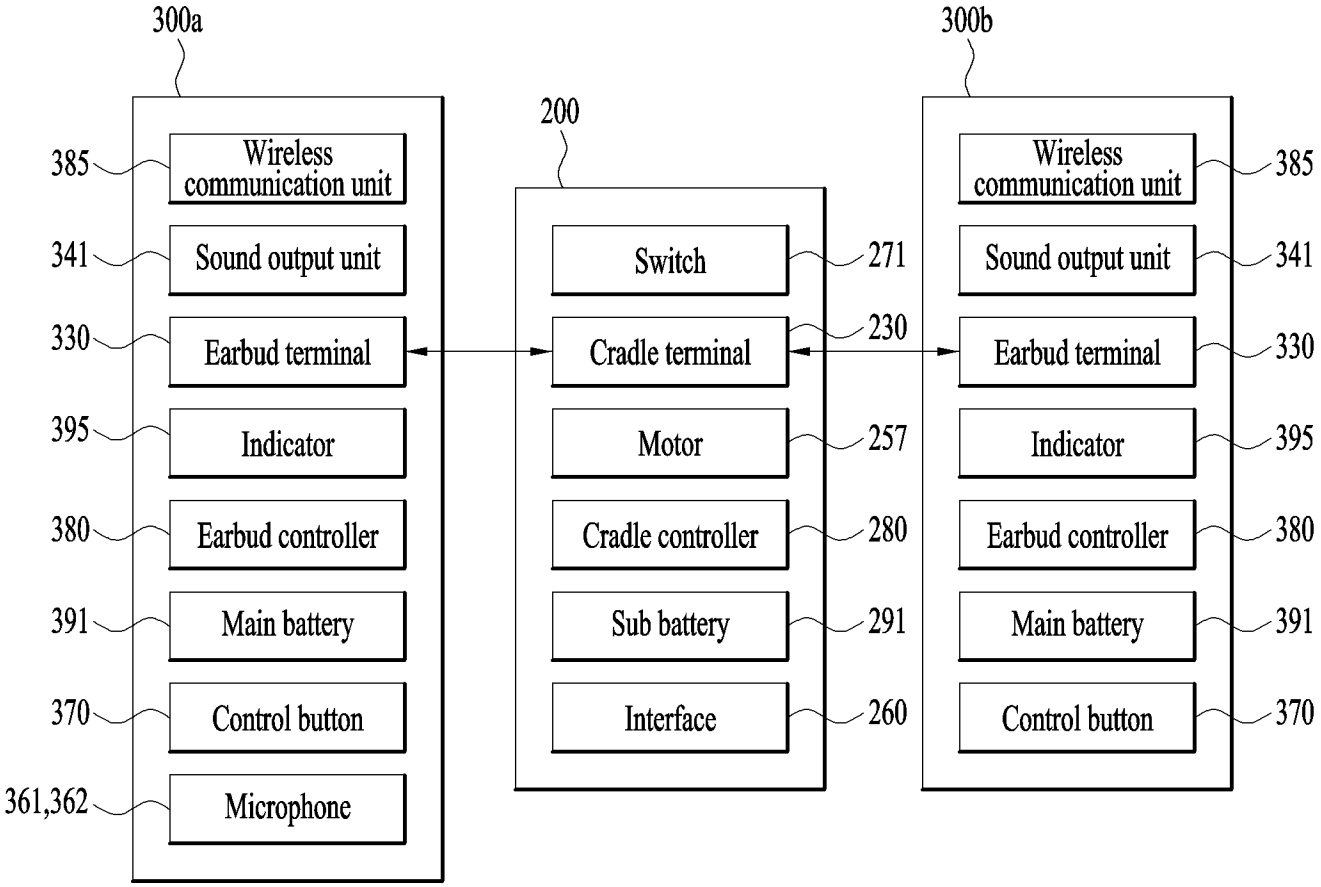
FIG. 2 is a block diagram to describe the example of the wireless sound equipment 100.

FIG. 2 is a block diagram to describe the example of the wireless sound equipment 100. Each of the earbuds 300 may include a wireless communication unit 385; a sound output unit 341; an earbud terminal 330; an indicator 395; an earbud controller 380; and a main battery 391. Only one of the earbuds 300 may further include a microphone 361 and 362.

The pair of the earbuds 300 may consist of one earbud 300 wearable on the left ear and the other earbud 300 wearable on the right ear. Only one of the earbuds 300 is connected to an external terminal and the other one is configured to receive a signal from the external terminal and output sound data according to the received signal. If both of the earbuds 300 are connected to the external terminal, data delay is likely to occur according to a communication state with the external terminal and cause an error in synchronization between the sound outputs from the both earbuds. In addition, if both of the earbuds 300*a* and 300*b* are communicable with the external terminal, much energy could be consumed the usage time of the main battery 391 could be reduced accordingly.

The earbud 300 capable of transceiving data by being directly connected to the external terminal may be referenced to as a master earbud 300*a* and the earbud 300 capable of outputting sound based on the data transmitted from the master earbud 300*a* as a slave earbud 300*b*. The illustrated embodiment shows a left earbud 300 wearable on the user's left ear is determined as the master earbud 300*a* and the embodiment is not limited thereto. The reverse case is applicable.

The wireless communication unit 385 of the master earbud 300*a* is implemented to perform wireless communication with the external terminal and the slave earbud 300*b*. The wireless communication unit 385 of the slave earbud 300*b* is implemented to perform wireless communication with the master earbud 300*a*. The wireless communication unit 385 uses short range wireless communication technique to transceiver a signal with a portable terminal which is located nearby. Such short range wireless communication technique is capable of supporting short range communication by using one or more of Bluetooth™, Radio Frequency Identification (RFID), Infrared Data Association (IrDA), Ultra Wideband (UWD), ZigBee, Near Field Communication (NFC), Wireless-Fidelity (Wi-Fi), Wi-Fi Direct, and Wireless USB (Wireless Universal Serial Bus).

The sound output unit 341 is provided in each of the earbuds 300 as a device configured to output sound according to a sound signal. The earbud controller 380 is implemented to control the sound output unit 341 according to the sound signal transmitted from the wireless communication unit 385.

The indicator 395 is configured to display the residual of the main battery 391 after the earbud 300 senses power ON/OFF of the external terminal. A light-emitting component, for example, an LED (395, see FIG. 7) may be used as the indicator 395 and diverse information may be provided by using color variation, the frequency and interval of flickering.

The main battery 391 may provide electric power to the earbud controller 380, the sound output unit 341, the wireless communication unit 385 and the indicator 395 which are loaded in the earbuds 300. The earbud 300 is small-sized so that the main battery 391 may be supplied the electric power via the earbud terminal 330 configured to contact with the cradle terminal 230 to charge, when not in use.

A control button 370 may be provided in the earbud 300 to facilitate simple control even unless the user is holding the terminal in the hand. Compared with the conventional neckband type wireless sound equipment, the example of the wireless sound equipment includes the small-sized earbud 300 and the number of the buttons is reduced. One control button 370 in accordance with the illustrated embodiment may be provided in each of the earbuds 300.

The microphone 361 and 362 may be provided only in the master earbud 300*a*. It is possible to provide the microphone in the slave earbud 300*b*. As the master earbud 300*a* is directly connected to the external terminal, the microphone may be provided only in the mater earbud 300*a*. If using the microphone 361, 362 provided in the slave earbud 300*b*, there might be time deviation in the wireless communication. Because of that, the microphone 361 and 362 is located in the master earbud 300*a* and the master earbud 300*a* is capable of transmitting the sound information collected in the microphone to the external terminal directly.

One sub-battery 291 located in the cradle 200 may be provided in each of the right and left portions because of the weight balance and size limitation possessed by the cradle 200. The sub battery 291 supplies the electric power to the earbuds 300 via the cradle terminal 230. The cradle 200 is larger than the earbud 300 so that the sub battery 291 can have a larger capacity than the main battery 391 located in the earbud 300. To charge the sub battery 291, an interface unit 260 may be further provided and configured to facilitate connection with an external power supply source.

The cradle 200 may not only supply the electric power to the earbud 300 via the cradle terminal 230 but also receive information about a state of the earbud 300 to control ON/OFF of the earbud 300. When the mater earbud 300*a* receives event information from the external terminal, the earbud terminal 330 may transmit information about generation of corresponding event (for example, call receiving) to the cradle terminal 230 and the cradle controller 280 drives the motor 257 to notice the event generation to the user.

When the user insertedly wears the earbuds 300 on the ears, it is possible to output a call reception sound via the earbud 300 so as to notice the event generation to the user. Unless the user wears the earbud 300, it is impossible to sense the event generation and then the event generation could be noticed by using the motor 257 provided in the cradle 200. The cradle 200 in accordance with the present disclosure is directly put on the user's body, so that it can notice the event generation to the user as well as function as a charger and rest.

The cradle 200 may not communicate with the external terminal wirelessly and the earbud 300 may be controlled independently. In this instance, the cradle 200 may include a switch 271 for turning on/off the function of the earbud 300. When the switch 271 is switched on, the cradle controller 280 may receive information on the event received by the earbud 300 via the cradle terminal 230 and notice the event generation to the user by using the vibration generated by driving the motor 257. It is possible to switch on and off the power of the earbud 300 based on the on and off of the switch 271. Detailed description of the related specific control will be described later.

Figure 3:
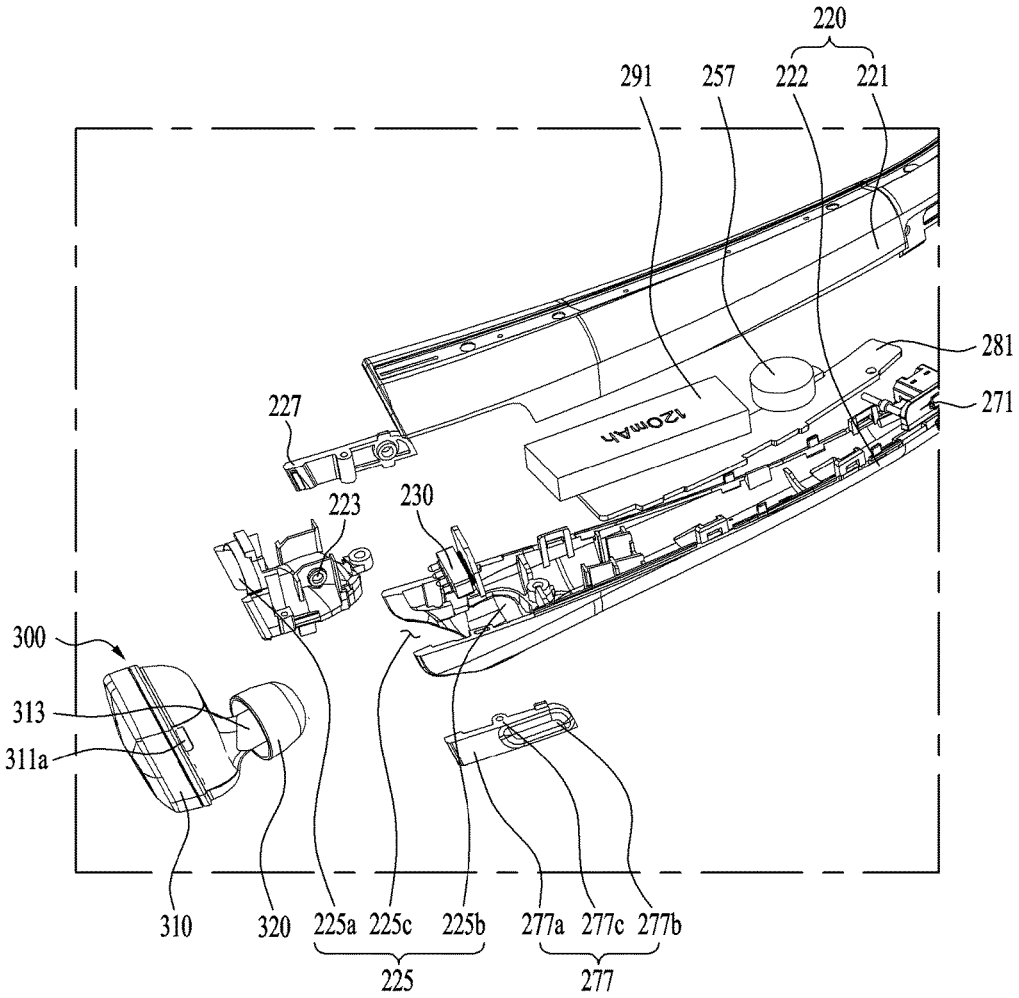
FIG. 3 is an exploded perspective diagram illustrating the example of the wireless sound equipment.

FIG. 3 is an exploded perspective diagram illustrating the example of the wireless sound equipment 300. It shows a battery, a motor 257 and a cradle circuit board 281 as a controller, which are located in a cradle case 220. In the embodiment, the cradle case 220 may consist of an upper case 221, a lower case 221 and a holder case 223 for covering the holder 225.

The holder 225 may be inserted for an ear tip 320 of the earbud 300 to be toward the holder 225. The ear tip 320 is located toward the inside of the holder 225 not to expose the ear tip 320 outside. If the ear tip 320 having an uneven portion is exposed outside, the earbud 300 is likely to become separated from the holder 225 and get lost by caught in the clothes. The holder 225 may include a first accommodating portion 225*a* accommodating the main body of the earbud 300; and a second accommodating portion 225*b* inserted more than the first accommodating portion 225*a* and accommodating the ear tip 320.

A predetermined portion 225*c* of a wall surrounding the second accommodating portion 225*b* is partially omitted as shown in FIG. 3, so as to prevent the ear tip 320 from being turned over by getting stuck in the second accommodating portion 225*b*, when the separating the earbud 300 from the holder 225.

A hook lever 277 for fixing the earbud 300 may be further provided to prevent the separation of the earbud 300 from the holder 225. A pair of hook levers 277 may be provided in right and left sides of the holder 225 and coupled to the holder 225 by a hinge 277*b*. The hook lever has a hook projection provided in one side with respect to the hinge 277*b* and a hook button provided in the other side to be pressable by the user. When the earbud 300 is located in the holder 225, the hook projection 277*a* is insertedly fitted to a hook groove 311*a* of the earbud 300 and the earbud 300 is secured. When the user presses the hook button 277*c*, the hook projection 277*a* is separated from the hook groove 311*a* of the earbud 300 so that the user can take the earbud 300 out of the holder 225 easily.

It is possible to provide a magnet in the holder 225 to make the earbud 300 detachable by using a magnetic force. However, the cradle 200 is not connected with the earbud 300 and a more strong coupling structure is required. Accordingly, the hook lever 277 may be applied.

A plurality of cradle terminals 230 projected in the holder 225 may be provided. When the earbuds 300 are coupled to the holders 225, the cradle terminals 230 may be linked to the earbud terminals 330 exposed to the earbuds 300 and configured to receive information about the earbud 300 via the earbud terminals 330 or supply the electric power to the earbuds 300.

Only when at least one of the earbud terminal and the cradle terminal 230 is made of an elastic material, the earbud terminals 330 and the cradle terminals 230 may be liked stable. The earbud terminal 330 may have an exposed portion made of metal and the cradle terminal 230 provided in the holder 225 made of an elastic material such as a pogo pine. In case the earbud terminal 330 is projected, the user's feeling of wearing on the ear might deteriorate but the cradle terminal 230 becomes located in the holder 225 not to affect the exterior so that the cradle terminal 230 can be realized as an elastic type.

When the magnet is provided in the holder 225, the earbud 300 may further include a hall sensor for sensing the magnetic forces of the magnet. The earbud controller 380 may transmit a control signal to an external terminal via the wireless communication unit 385 to end the executed music or the call once the hall sensor senses the magnetic force of the magnet provided in the holder 225.

Figure 4:
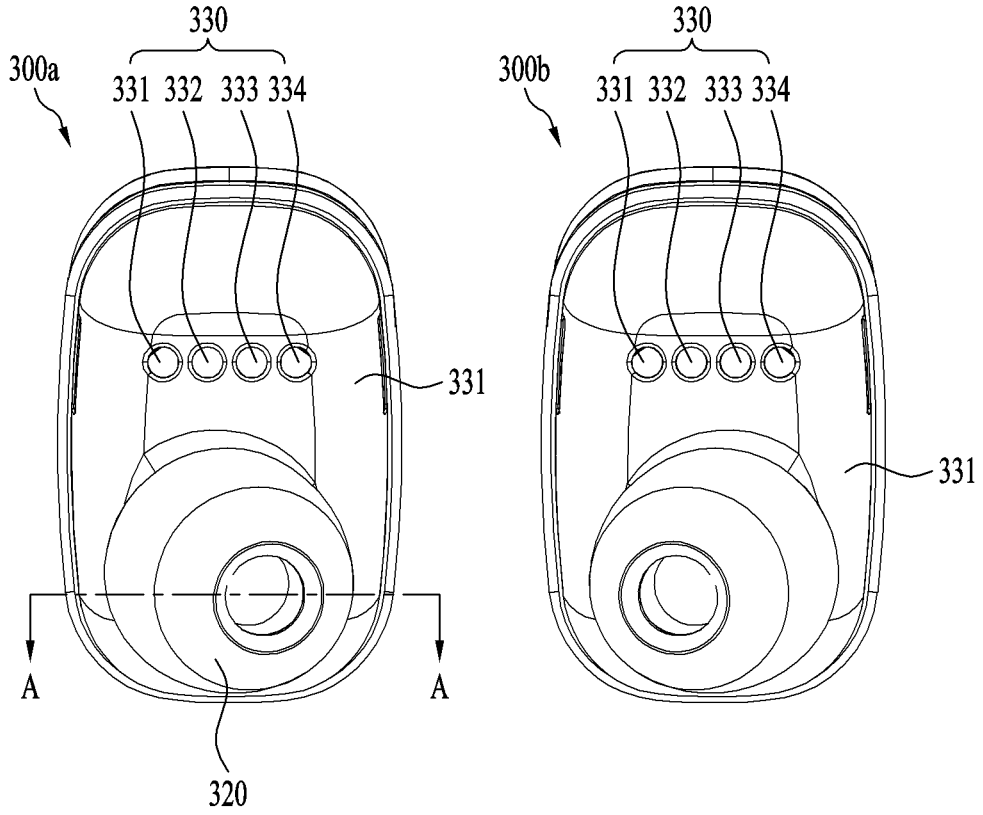
FIG. 4 is a diagram illustrating an earbud of the wireless sound equipment.

FIG. 4 is a diagram illustrating the earbud 300 provided in one example of the wireless sound equipment 100. One earbud 300 wearable on the left ear and the other earbud 300 wearable on the right ear may be formed symmetrically in shape. The user's external auditory meatus is inclined a little forward from a lateral side to an inner side. Accordingly, the ear tip 320 inserted in the ear has to be inclined forward from the main body of the earbud 300 for good wearing feeling without getting separated easily.

The earbud 300*a* shown in the left side is bent rightward from the main body to be worn on the left ear, so that a sound passage 313 can be extended. The earbud 300*b* shown in the right side may be the earbud 300 worn on the right ear.

Figure 5:
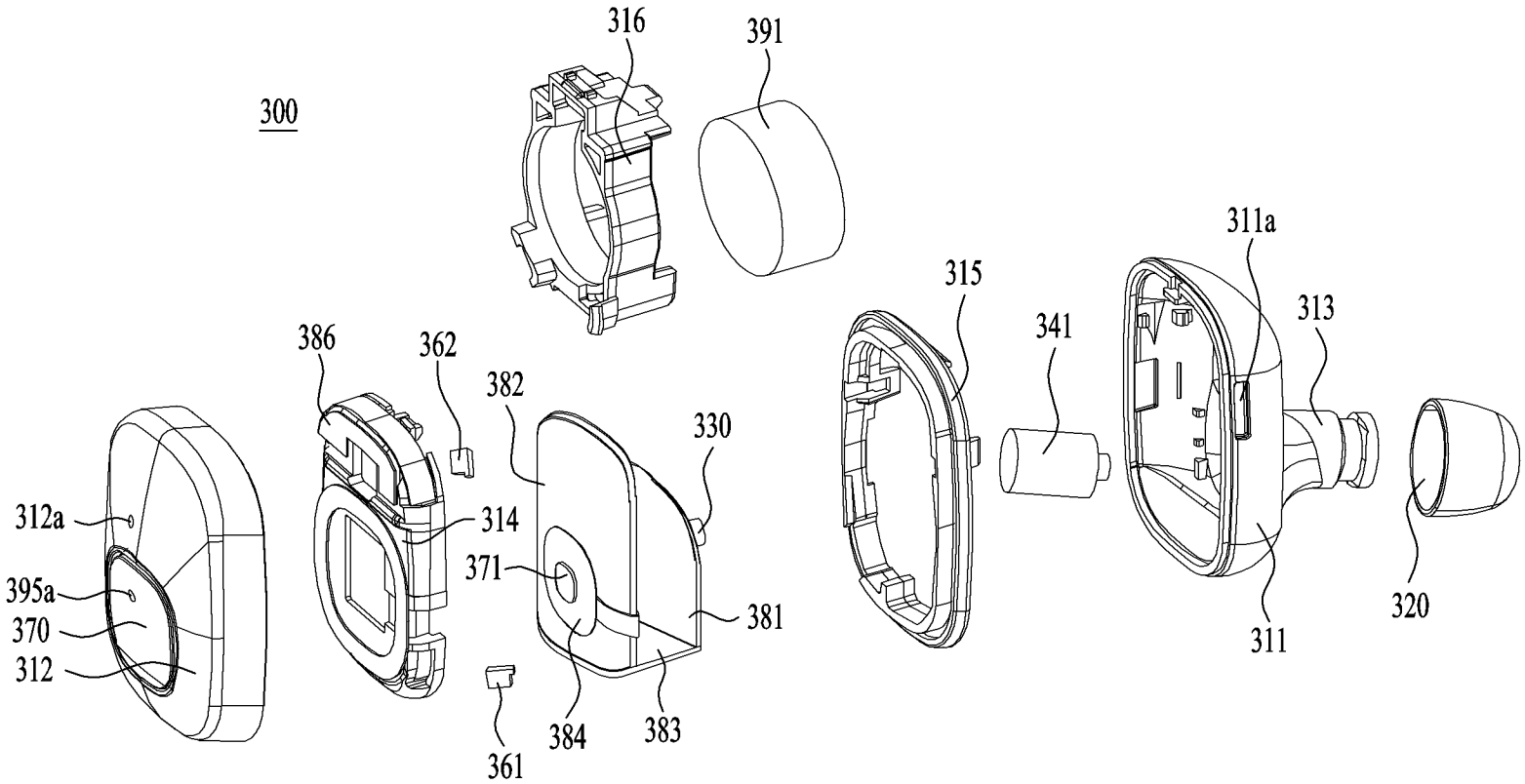
FIG. 5 is an exploded perspective diagram illustrating the earbud of the wireless sound equipment.
Figure 6:
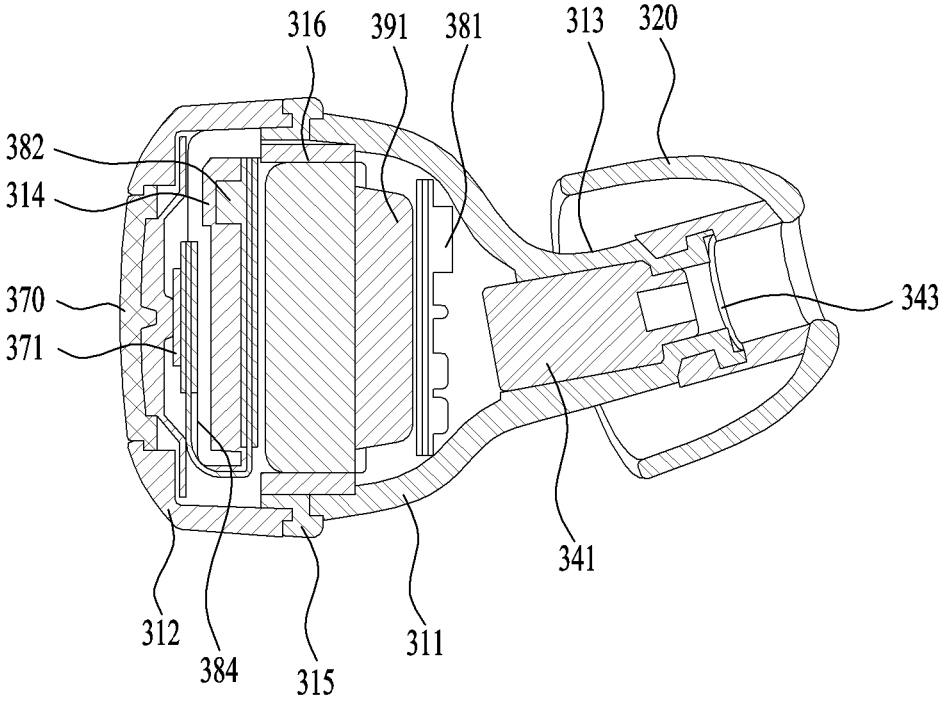
FIG. 6 is a sectional diagram along A-A shown in FIG. 4.

FIG. 5 is an exploded perspective diagram illustrating the earbud of the wireless sound equipment and FIG. 6 is a sectional diagram along A-A shown in FIG. 3. The earbud 300 in accordance with the present disclosure includes an ear housing 310; a sound passage 313; an ear tip 320; a sound output unit 341; a wireless communication unit 385; an earbud controller 381, 382, 383 and 384; a main battery 391; an earbud terminal 330; and a control button 370.

The ear housing 310 may include a first housing 311 defining a first surface of the earbud 300 and having the sound passage 313 projected therefrom; and a second housing 312 defining a second surface of the earbud 300 and having the control button 370 located therein. The sound passage 313 projected from the first housing 311 may be inserted in the user's ear and through which the sound output from the sound output unit 341 is delivered to the user. The ear tip 320 made of an elastic material may be insertedly fitted to on end of the sound passage 313 to be closely worn the user's ear.

In an internal space formed between the first housing 311 and the second housing 312 may be located first and second circuit boards 382 as the earbud controller 380; the main battery 391; the microphone 361 and 362; a dome switch 271 for generating a signal when the control button 370 is pressed; and the sound output unit 341.

To secure those components stably, a middle frame 315 may be further provided between the first housing 311 and the second housing 312. The middle frame 315 may be located within the first and second housings 311 and 312 or partially exposed as shown in FIG. 3.

The earbud 300 is small-sized and it is difficult to secure a sufficient circuit board size. Accordingly, a plurality of circuit boards may be overlapped as shown in FIG. 4. The earbud controller 380 in accordance with the present disclosure includes a first circuit board 381, a second circuit board 382 and a flexible circuit board 384 connecting the first and second circuit boards with each other. The main battery 391 may be arranged between the first circuit board 381 and the second circuit board 382. A battery bracket 316 may be further provided to secure the first circuit board 381, the main battery 391 and the second circuit board 382.

The first circuit board 381 is located toward the first surface of the earbud 300 and the earbud terminal 330 configured to be linked to the cradle terminal 230 located in the holder 225 of the cradle 200 may be arranged on the first circuit board. The second circuit board 382 may be located toward the second surface of the earbud 300 and the microphone 361 and 362 and the wireless communication unit 385 may be arranged on the second circuit board.

The first surface of the earbud 300 is the portion which contacts with the user's body when the user wears the earbud 300. The second surface of the earbud 300 is located outward from the user's body.

The sound output unit 341 is capable of reducing the loading space, when formed in the shape inserted in the sound passage 313. A waterproof material 343 with a mesh structure such as Goretex™ may be attached to the sound passage 313 to prevent water from entering into the sound output unit 341. Air is capable of penetrating the waterproof material 343, not water.

The earbud terminals 330 shown in FIG. 4 may be located in the first surfaces of the left and right earbuds 300, respectively, and four earbud terminals 330 may be provided. The more earbud terminals 330 are provided, the more advantageous it is to control. The more earbud terminals 330 are provided, the more loading space is needed so that it can be difficult to make the earbud 300 in a compact size. Accordingly, in the embodiment, the earbuds 300 may include four earbud terminals 330, respectively.

The wireless communication unit 385 located in the second surface of the earbud 300 includes an antenna radiator for transceiving a wireless signal. It is preferred that the antenna radiator 386 is located in an outer portion as possible, not in contact with the user's body, because it transceiver the wireless signal.

To minimize the influence on the internal components and the interference of the internal components, an auxiliary antenna carrier 314 may be provided and the antenna radiator 386 may be located over the antenna carrier 314. Especially, it is preferred that the antenna radiator 386 is arranged in an upper portion of the second surface of the earbud 300 as shown in FIG. 5.

Figure 7:
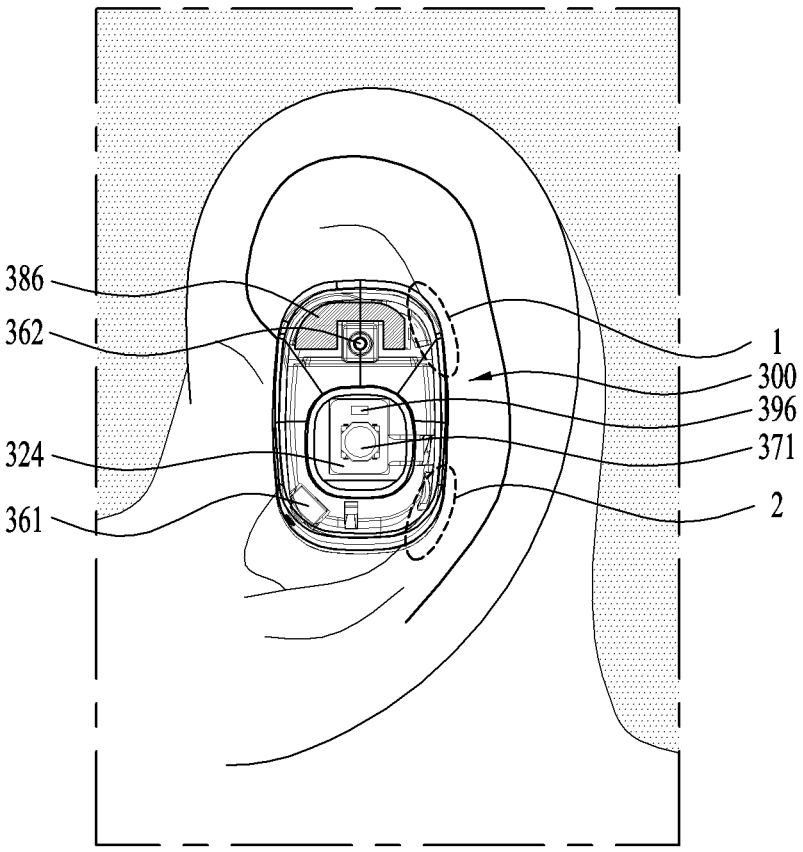
FIG. 7 is a perspective diagram illustrating a state where a user wears the earbud of the wireless sound equipment.

FIG. 7 is a perspective diagram illustrating a state where a user wears the earbud 300 of the wireless sound equipment 100. The second surface of the earbud 300 is located in opposite to the first surface configured to contact with the user's ear and a right corner of the second surface formed in the earbud 300 is fitted to the user's antihelix 1 and antitragus 2 so as for the earbud 300 to be stably worn on the user's ear. In other words, the two corners of the second surface are configured to contact with the user's body.

FIG. 7 illustrates the earbud 300*a* configured to be worn on the user's left ear. In case of the earbud 300*b* configured to be worn on the right ear, the corners configured to contact with the user's body are left upper and lower corners. In other words, the corners in opposite to the direction in which the sound passage is extended may be configured to contact with the user's body.

As mentioned above, when the antenna radiator 386 is arranged in the portion configured to contact with the user's body, the wireless communication performance ends up deteriorating. Some portion configured to contact with the user's antihelix 1 may be omitted in the antenna radiator 386 shown in FIG. 7.

The microphone 361 and 362 is provided as a device configured to collect the user's voice for a call or a voice command. A first microphone 361 is arranged close to the user's mouth. As mentioned above, the microphone 361 and 362 mounted only in the master earbud 300*a* inserted in the left ear may be arranged in the left end of the second surface provided in the earbud 300.

The wireless sound equipment 100 in accordance with the present disclosure may further include a second microphone 362 configured to additionally collect sound in another direction so as to remove external noise. The second microphone 362 may be arranged in a different direction, spaced a distance apart from the first microphone 361, and then collect sound in a different direction from the first microphone 361. For example, the second microphone 362 is capable of collecting external noise and the first microphone 361 and extracting the user's voice collected by the first microphone 361.

The first microphone 361 of the first embodiment is located the left end of the earbud 300 and it is preferred that the farthest gap is provided in a right upper end of the earbud 300. However, the right upper end of the earbud 300 is configured to contact with the user's antihelix so that the second microphone 362 may be arranged over the second surface, which is the portion not in contact with the user's antihelix 1 as shown in FIG. 7.

The first microphone 361 shown in FIG. 7 is formed in a lateral surface of the ear housing 310 toward the user's mouth and the second microphone 362 is located in the second surface of the ear housing 310. Each of the first and second microphones 361 and 362 may collect sound in a different direction. Also, the first and second microphones 361 and 362 may be arranged in the ear housing 310, spaced from each other in a range of distances where they are not hidden by the user's ears.

To locate the second microphone 362 in an upper portion of the second surface of the ear housing 310, the antenna radiator 386 may be omitted and the portion where the microphone 361 and 362 is located may not be overlapped with the antenna radiator 386.

The control button 370 is located in the second surface of the earbud 300 and the earbud 300 is small-sized. Accordingly, the number of the control button pressing frequencies and the pressing time may be differentiated to input diverse commands.

When the control button 370 is pressed one time, music starts to be played in a standby state, the playing music is paused or a call is answered in case of receiving a call signal or an active call is cut off. When the control button 370 is pressed two times continuously in a standby state, the current state is converted into a voice dial mode and the telephone number the user spoke is dialed or the person the user spoke is searched in a contact list to make a call. When the control button is pressed and held or two times continuously while receiving a call signal, a call receiving is able to be rejected.

When the control button 370 is pressed for a preset time period or more (for example, 5 seconds or more), the current state is converted to a state for being connected to an external terminal. At this time, the wireless sound equipment is automatically connected to the external terminal if a connected external terminal is located nearby and sends a signal in a state where the external terminal is able to search the wireless sound equipment 100 if there is no connected external terminal located nearby.

Only the master earbud 300*a* of the earbud 300 in accordance with the present disclosure may directly perform wireless communication with the external terminal and a call function or a pairing function for connecting the wireless sound equipment to the external terminal may be performed only in the master earbud 300*a*, so that such function cannot be realized in the control button 370 of the earbud 300*b*. Table 1 is a list of the functions realized by the manipulation of the control button 370.

TABLE 1

| | Function | Mode | Master Earbud | Slave Earbud |
|---|---|---|---|---|
| Music play | Play | Standby | Press one time | Press |
| | Pause | play | Press one time | Press |
| Call | Voice dial | standby | Press two consecutive times | N/A |
| | Connect | Call signal | Press one time | |
| | Reject | Call signal | Press and hold (2") | |
| | End | Active call | Press one time | |
| Synchronization | Synchronization | Standby | Press and hold (3") | |

The wireless sound equipment 100 is small-sized and is not able to form various buttons in the earbud 300. It is difficult to additionally include buttons for volume control, change of the playlist order and fast forward.

The slave earbud 300*b* performs wireless communication with the master earbud 300*a* and is able to include two control buttons 370 for volume control, change of the playlist order and fast forward and perform additional control. Rather than that, the frequency or time of the control button 370 pressing is differentiated to perform the functions for sound off, re-dial and voice commands.

The control button 370 may be provided as a touch type and the wireless sound equipment 100 is a wearable device. When the user presses the control button 370, a signal is generated by using a dome switch 371 to minimize input errors. The dome switch 371 is inserted in a hole formed in the second housing 312 and it is connected with the second circuit board 382 and the flexible circuit board 384 to be located between the second housing 312 and the antenna carrier 314, closer to the second housing 312 than the antenna carrier 314.

An indicator 395 may be further provided in the second surface and the indicator 395 displays a battery residual and an ON/OFF state of the earbud 300 by color lights and flickering. An LED 396 is mounted on the flexible circuit board 384 to form the dome switch 371 and a transparent portion (or translucent portion) is provided in a button portion to realize the indicator 395.

Water might flow between the first and second housings 311 and 312 and the middle frame 315 and in a hole formed in the second housing 312 for the control button 370 and a hole formed in the end of the sound passage 313. The wireless sound equipment 100 which is the wearable device is likely to be exposed to moisture such as sweat easily. To prevent the moisture penetration, waterproof bonding is performed between two of the first and second housing 311 and 312 and the middle frame 315, and an elastic material is disposed on the control button 370. The waterproof mesh 343 is attached to the sound passage 313 to prevent the water penetration.

Figure 8:
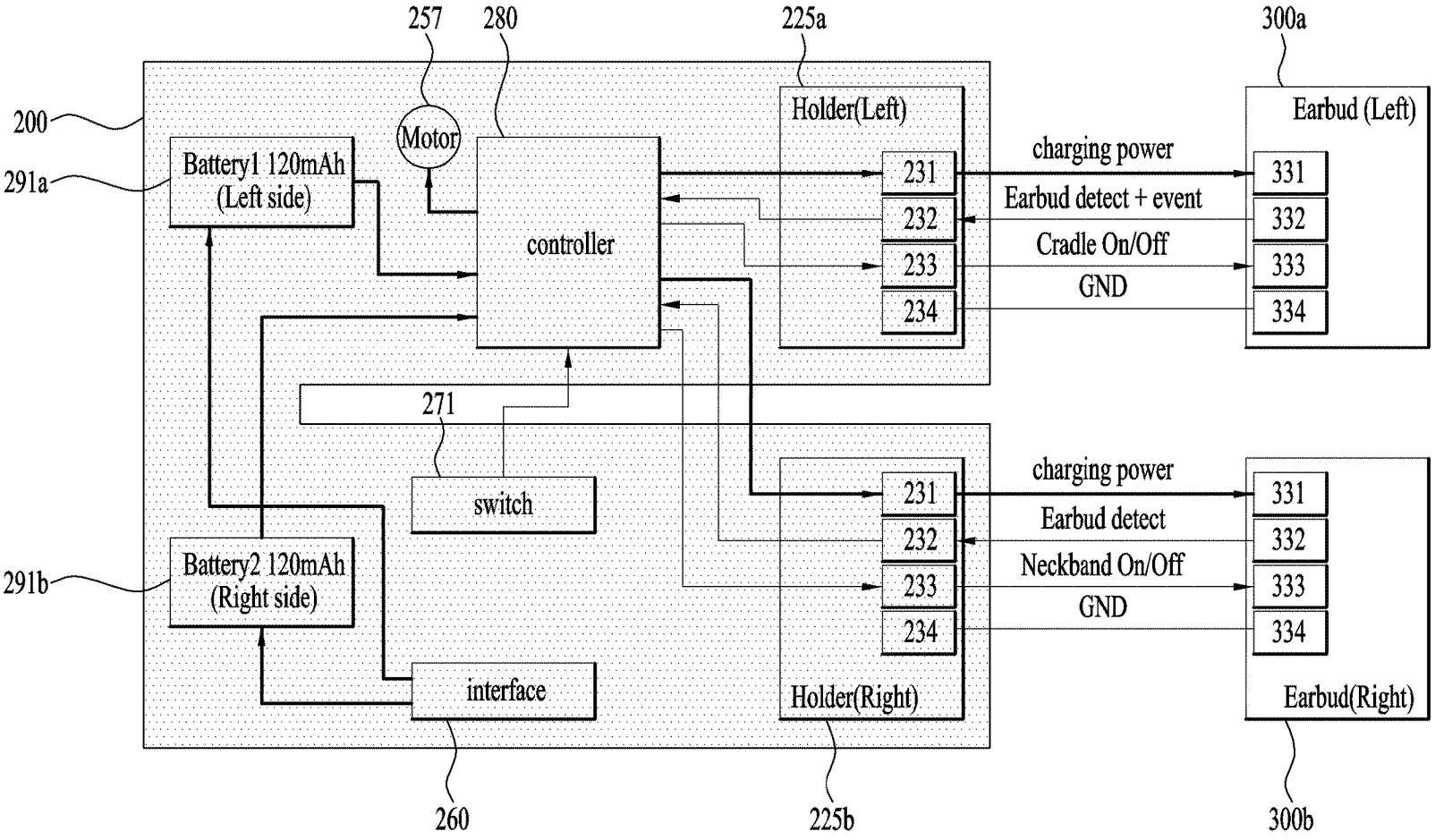
FIG. 8 is a conceptual diagram illustrating flow of a signal between a cradle terminal and an earbud terminal provided in the wireless sound equipment.

FIG. 8 is a conceptual diagram illustrating flow of a signal between the cradle terminal 230 and the earbud terminal 330 provided in the wireless sound equipment 100. Four earbud terminals 330 may be provided for each earbud 300 and four cradle terminals 230 may be provided in each holder 225. The number of the earbud terminals 330 and the cradle terminals 230 may be increased or decreased according to the functions of the wireless sound equipment 100.

A basic function of the earbud terminal 330 and the cradle terminal 230 is to transmit the electric power of the sub battery 291 provided in the cradle 200 to the main battery 391 provided in the earbud 300. A pair of terminals is required and one terminal is to supply the electric power and the other terminal is connected with the ground. In the illustrated embodiment, a first cradle terminal 231 supplies the power to a first earbud terminal 331. A fourth cradle terminal 234 is connected with a fourth earbud terminal 334 to function as a ground contact part.

The cradle in accordance with the present disclosure includes one sub battery 291*a* in the left side and the other sub battery 291*b* in the right side, so that cradle controller 280 may supply the electric power of the two sub batteries 291*a* and 291*b* to left and right first cradles 231, respectively.

The cradle 200 may further include a second cradle terminal 232 sensing whether the earbud 300 is coupled to the cradle 200, rather than the function of charging the main battery 391 of the earbud 300. When the cradle controller 280 continuously supplies the electric power to the first cradle terminals 231, the electric power of the sub battery 291 might be discharged disadvantageously. It is sensed whether the earbud 300 is coupled to the holder 225 based on the voltage variation generated when the second cradle terminal 232 is linked with the second earbud terminal 332.

Only when the earbud 300 is coupled to the holder 225, the electric power is applied via the first cradle terminal 231 to charge the main battery 391 of the earbud 300. The master earbud 300*a* directly performs wireless communication with an external terminal. When receiving a specific event, for example, a call signal, the master earbud 300*a* may notice the received specific event to the user. In this instance, when insertedly wearing the earbud 300, the user may be noticed via the sound output unit 341 of the earbud 300 that a call signal is received. However, when the earbud 300 is insertedly coupled to the holder 225 of the cradle 200, the user may not be noticed.

Accordingly, instead of noticing the event generation via the sound output unit 341 to the user, the master earbud 300*a* converts the voltage of the second earbud terminal 332 and the second cradle terminal 232 senses the voltage variation to transmit the event generation information to the cradle 200.

When receiving such the event generation from the cradle terminal 232, the cradle controller 280 notices the event generation to the user by operating the motor 257 of the cradle 200. In case a speaker or the like rather than the motor 257 is attached to the cradle 200, the cradle controller 280 may notify the user of the event generation by driving the speaker.

A third cradle terminal 233 is configured to transmit a state of the switch 271 formed in the cradle 200 to the earbud 300 via the earbud terminal 333 and control the activation of the earbud 300 coupled to the holder 225 according to ON/OFF of the switch 271.

FIG. 9 is a diagram to describe power ON/OFF relation between the earbud 100 and the cradle 200 provided in the wireless sound equipment 100. In case the earbud 300 is separated from the cradle 200, it can be said that the user is wearing the earbud 300. In this instance, the earbud 300 keeps an activated state. In other words, the earbud 300 is connected to an external terminal so that the user can make a call or listen to music.

However, when the earbud 300 is in an activated state in case the user is not wearing the earbud 300, the main battery 391 of the earbud 300 could discharge and the current state of the earbud 300 is converted into a deactivated state to be disconnected from the external terminal and cut off the electric power of the earbud 300.

The earbud 300 has a too small internal space to include the switch 271 for switching ON/OFF the power. In case the earbud 300 is not connected to an external terminal for a preset time period (for example, 3 minutes), the power of the earbud 300 may be switched off. When the user presses and holds the control button 370, the switched-off power becomes activated to connect the earbud 300 to the external terminal or the current state of the earbud is converted into a connectable state to an external terminal.

Accordingly, the state (ON/OFF) of the cradle 200 is determined by the ON/OFF state of the switch 271 and the state (ON/OFF) of the earbud 300 separated from the holder 225 of the cradle 200 is determined by the connection/disconnection with an external terminal. As-Is shown in a left portion of FIG. 9 means a state of the cradle 200 and the earbud 300 before the change (that is, the coupling/decoupling of the earbud 300 to/from the holder 225 or the switching conversion of the switch 271 provided in the cradle 200). To-Be means a state of the earbud 300 after the change.

When the ON-stated earbud 300 is coupled to the holder 225 in case the current of the cradle 200 is ON, the current ON state of the earbud 300 is maintained. When the OFF-stated earbud 300 is coupled to the holder 225, the current state is converted into the ON state. In case the current state of the cradle 200 is an OFF state, the current state of the earbud 300 is converted into an OFF state even in case the current state of the earbud 300 is an ON-state or an OFF-state.

More specifically, the earbud controller 380 of the earbud 300 coupled to the holder 225 receives information about the current state of the switch 271 provided in the cradle 200 via the earbud terminal 333 and converts the current state of the earbud 300. At this time, the current state of the cradle 200 is the ON state. When the earbud 300 is not connected to an external terminal for a preset time period even if the current state of the earbud 300 is converted into the ON state, the current state of the earbud 300 is converted into the OFF state.

When the switch 271 of the cradle 200 is switched ON or OFF in the reverse in a state where the earbud 300 coupled to the cradle 200, the current state of the earbud 300 depends on the current state of the cradle 200. In other words, when the current ON state of the cradle 200 is converted into an OFF state, the current state of the earbud 300 is converted into the OFF state unconditionally. When the earbud 300 is not connected to an external terminal for a preset time period, a state where the cradle 200 is ON-stated with the OFF-stated earbud 300 may occur.

When the OFF state of the cradle 200 is converted into the ON state, the current state of the earbud 300 is converted into the ON state. However, that situation cannot occur when the current state of the earbud 300 coupled to the OFF-stated cradle 200 is the ON state.

When the earbud 300 coupled to the holder 225 is detached from the cradle 200, the current state of the earbud 300 is converted into the ON state unconditionally. It can be determined that the user desires to use the earbud 300, when detaching the earbud 300 from the holder 225. Accordingly, the earbud 300 is activated and the current state of the earbud 300 is converted into the ON state to be connected with an external terminal or the connectable state. As mentioned above, the state where the earbud 300 coupled to the OFF-stated cradle 200 is ON-stated cannot happen.

The state of the earbud 300 coupled to the holder 225 is determined based on the state of the switch 271 provided in the cradle 200 and the earbud 300 is also OFF-stated in case the switch 271 is OFF-stated, not to be connected with an external terminal. In this instance, even when a call signal is transmitted, the user cannot receive a call via the wireless sound equipment 100. In contrast, even in case the switch 271 is ON-stated, the earbud 300 is also ON-stated. When a call signal is transmitted to the wireless sound equipment 100, the motor 257 of the cradle 200 is put into operation to notify the user of event generation.

The charging process starts in a state where the earbud terminal 330 in contact with the cradle terminal 230 after the earbud 300 is coupled to the holder 225 of the cradle 200, regardless of the ON/OFF state of the switch 271. As shown in FIG. 4, the first through fourth earbud terminals 331~334 are arranged from the left side to the right side in an order. Accordingly, even when the left side earbud 300 is coupled to the right holder 225, the charging function and the common functions of the earbud 300 may be all implemented.

Figure 11:
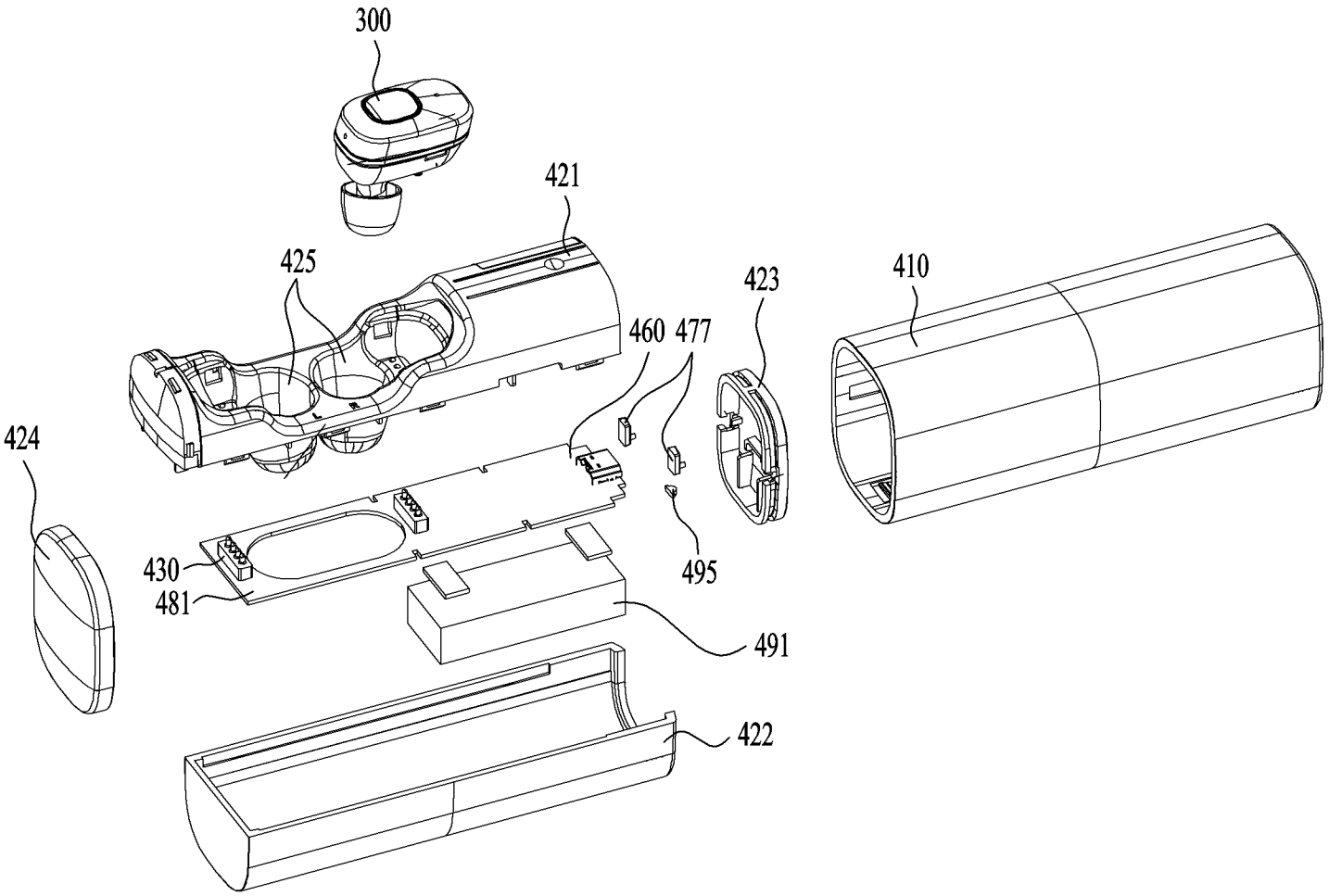
FIG. 11 is an exploded perspective diagram illustrating the cradle of FIG. 10.

FIG. 10 is a diagram illustrating a cradle 400 and an earbud 300 which are provided in another example of a wireless sound equipment 100. FIG. 11 is an exploded perspective diagram illustrating the cradle 400 of FIG. 10. FIG. 12 is a sectional diagram the cradle 400 of FIG. 10. Different from the neck wearable cradle 200 in accordance with the embodiments mentioned above, the cradle 400 is a portable type easy to be kept in a bag.

The cradle 400 in accordance with the illustrated embodiment may further include a cradle case 420 in which a battery and a cradle controller are located; and a cover case 410 covering a holder 425 formed a cradle case 420. When the cradle case 420 is fitted to the cover case 410 formed in a cylindrical shape, the holder 425 shown in FIG. 10 (*a*) is hidden. When the cover case 410 is pushed, the holder 425 is exposed so that the user can couple or decouple the earbud 300 to or from the holder 425.

Different from the cradle 200 of the embodiment mentioned above, the cradle 400 of the illustrated embodiment is not worn on the user's neck and not able to provide the user with state information by using vibration. Accordingly, the cradle 400 may include no motor 257. As shown in Table shown in FIG. 9, it is not necessary to control the state of the earbud 300. Once the earbud 300 is coupled to the holder 425, the current state of the earbud 300 is converted into the OFF state unconditionally. Once it is decoupled from the holder 425, the current state of the earbud 300 is converted into the ON state. The cradle 400 of the illustrated embodiment includes no switch 271 and no third cradle terminal

430 for transmitting information about the state of the switch 271 to the earbud 300. Accordingly, the third cradle terminal 430 provided in the cradle 400 of this embodiment may have only the shape or be omitted.

The cradle 400 of this embodiment includes an upper case 421 and a lower case 422 and further a pair of lateral cases exposed by the cylindrical cover case 410. Also, the cradle 400 may further include an interface unit 460 connected to one of the lateral cases and an indicator 495 for displaying a charging state of the cradle 400. The indicator 495 may display the remaining power of a sub battery 491 located in the cradle 400 or the charging level of the charging earbud 300.

The holder 425 may be stepped by a first accommodating portion 425*a* and a second accommodating portion 425*b*. The cradle terminal 430 may be arranged in the first accommodating portion 425*a*, as mentioned above. However, different from the embodiment mentioned above, the earbud 300 is covered by the cover case 410 and the accidental separation of the earbud 300 from the holder 425 may be prevented, without the strong securing structure configured of the hook projection and the lever provided in the embodiment mentioned above.

In this instance, a hook 477 partially made of an elastic material may be provided in the holder 425 to keep a linked state between the earbud terminal 330 and the cradle terminal 430, so that the earbud 300 can be prevented from become movable in the holder 425 by the hook 477. For example, a rubber hook 477 may be provided or a securing state between the hook 477 and the earbud 300 is maintained by a weak spring. Even in this state, when the user pulls the second housing 312 of the earbud 300, the earbud 300 can be decoupled from the holder easily.

As shown in FIG. 12 (*a*), rails 417 and 427 may be provided in right and left portion of the cradle case 420 and in the cover case 410 to facilitate sliding motion of the cover case 410 in the cradle case 420. A hooking projection 426 is projected from the cradle case 420 as shown in FIG. 12 (*b*) to prevent the cover case 410 sliding along the rails 417 and 427 from escaping from the cradle case 420. A guide groove 416 may be further provided to facilitate some movement of the hooking projection. The hooking projection 426 is movable only within the guide groove 416, so that the cover case 410 can be movable only in a preset range.

As mentioned above, the wireless sound equipment 100 in accordance with the present disclosure may include no sound cable, thereby solving the uncomfortableness the user feels when the sound cable is stuck in the clothes. When not using the wireless sound equipment 100, the user is able to rest the earbud in the cradle wearable on the neck easily. Accordingly, the present disclosure may promote portable convenience. Even when not wearing the earbud 300, the user may be notified of presence of the generated event such as call receiving by the cradle.

The foregoing embodiments are merely exemplary and are not to be considered as limiting the present disclosure. The present teachings can be readily applied to other types of methods and apparatuses. This description is intended to be illustrative, and not to limit the scope of the claims.

What is claimed is:

1. A wireless sound equipment comprising:

a cradle comprising a pair of holders, and a pair of earbuds coupled to the pair of holders, wherein each of the earbuds comprises:

an ear housing having a first portion and a second portion;

a sound passage extended from the first portion of the ear housing;

a sound output unit configured to output sound via the sound passage;

a wireless communication unit located in the ear housing;

an earbud controller configured to drive the sound output unit based on a signal transmitted by the wireless communication unit;

a plurality of earbud terminals connected to the earbud controller, the plurality of earbud terminals being located at the first portion of the ear housing;

a main battery for supplying electric power; and a control button located at the second portion of the ear housing;

wherein the cradle comprises:

a cradle case in which the holders are located;

a plurality of cradle terminals provided to each of the holders, the plurality of cradle terminals being configured to contact the plurality of earbud terminals when the pair of earbuds is coupled to the pair of holders;

a sub battery located in the cradle case;

a switch; and a cradle controller, wherein the plurality of cradle terminals comprise:

a first cradle terminal configured to transmit electric power of the sub battery to the main battery of the earbud;

a second cradle terminal for sensing whether the earbud is coupled thereto; and a third cradle terminal configured to transmit a state of the switch to the earbud, wherein the cradle controller is configured to supply the electric power of the sub battery to the main battery via the first cradle terminal when the second cradle terminal senses the coupling of the earbud thereto, and wherein the earbud controller is configured to convert an ON/OFF state of the earbud according to an ON/OFF state of the switch when the earbud is coupled to the holder.

2. The wireless sound equipment of claim 1, wherein the holder comprises a magnet, wherein the earbud comprises a hall sensor for sensing the magnet, and wherein the earbud controller is configured to transmit a control signal for ending playing of music or connection of a call to an external terminal connected by the wireless communication unit when the hall sensor senses the magnet.

3. The wireless sound equipment of claim 1, wherein the earbud controller comprises:

a first circuit board located adjacent to the first portion of the ear housing, the sound output unit and the plurality of earbud terminals being connected to the first circuit board;

a second circuit board located adjacent to the second portion of the ear housing, the second circuit board including a dome switch that is pressed when the control button is pressed; and a flexible circuit board connecting the first circuit board and the second circuit board with each other, and wherein the main battery is located between the first circuit board and the second circuit board.

4. The wireless sound equipment of claim 1, wherein the ear housing has a longitudinal shape with a vertical length longer than a horizontal width, wherein the sound passage extends toward a lower portion of the ear housing and is inclined in a first direction leftward or rightward with respect to a vertical direction of the first portion of the ear housing, and wherein an antenna radiator is provided at an upper portion of the ear housing.

5. The wireless sound equipment of claim 4, wherein an extent of the antenna radiator in a second direction opposite to the first direction in which the sound passage is inclined is less than an extent of the antenna radiator in the first direction.

6. The wireless sound equipment of claim 4, further comprising a first microphone located at a lower corner of the ear housing in the first direction.

7. The wireless sound equipment of claim 6, further comprising a second microphone located at the second portion of the ear housing, the second microphone being arranged to not overlap the antenna radiator.

8. The wireless sound equipment of claim 1, wherein the pair of earbuds comprises:

a master earbud configured to connect with an external terminal for transceiving data; and a slave earbud configured to receive data from the master earbud.

9. The wireless sound equipment of claim 1, wherein the cradle case has a C-shaped curve to be wearable on a neck of a user, and wherein the holders are arranged at ends of the C-shaped curve of the cradle case.

10. The wireless sound equipment of claim 1, wherein each of the holders comprises:

a first accommodating portion configured to accommodate the ear housing; and a second accommodating portion configured to accommodate the sound passage, wherein the second accommodating portion is recessed further into the holder than is the first accommodating portion.

11. The wireless sound equipment of claim 10, wherein the second accommodating portion includes a cut-away portion.

12. The wireless sound equipment of claim 1, further comprising:

a hook projection configured to couple to the earbud; and a hook lever including a hook button configured to be pressed by a user to decouple the hook projection from the earbud.

13. The wireless sound equipment of claim 1, wherein the cradle further comprises a cover case covering the holders, wherein the cover case has a cylindrical shape, and wherein the cover case is slidingly coupled to the cradle case.

14. The wireless sound equipment of claim 1, wherein the second cradle terminal is configured to transmit event information about an event received via the wireless communication unit of the earbud, and wherein the cradle is configured to notify a user of the event information.

15. The wireless sound equipment of claim 1, wherein the earbud controller is configured to convert a power state of the earbud when sensing the conversion of the ON/OFF state of the switch via the third cradle terminal in a state where the earbud is coupled to the holder.

16. The wireless sound equipment of claim 1, wherein the cradle further comprises a charging connector, wherein the cradle switches off power of the earbud when electric power is supplied via the charging connector, and wherein the cradle converts the ON/OFF state of the earbud according to the ON/OFF state of the switch when the electric power supplied via the charging connector is stopped.

17. The wireless sound equipment of claim 1, wherein the earbud controller is configured to convert a power state of the earbud into an ON state when the earbud is decoupled from a respective one of the pair of holders.

18. The wireless sound equipment of claim 1, wherein the earbud controller is configured to switch off power of the earbud when the wireless communication unit is disconnected from an external terminal for a preset time period or more.

19. A wireless sound equipment comprising:

a cradle comprising a pair of holders, and a pair of earbuds coupled to the pair of holders, wherein each of the earbuds comprises:

an ear housing having a first portion and a second portion;

a sound passage extended from the first portion of the ear housing;

a sound output unit configured to output sound via the sound passage;

a wireless communication unit located in the ear housing;

an earbud controller configured to drive the sound output unit based on a signal transmitted by the wireless communication unit;

a plurality of earbud terminals connected to the earbud controller, the plurality of earbud terminals being located at the first portion of the ear housing;

a main battery for supplying electric power; and a control button located at the second portion of the ear housing;

wherein the cradle comprises:

a cradle case in which the holders are located;

a plurality of cradle terminals provided to each of the holders, the plurality of cradle terminals being configured to contact the plurality of earbud terminals when the pair of earbuds is coupled to the pair of holders;

a sub battery located in the cradle case; and a cradle controller, wherein the plurality of cradle terminals comprise:

a first cradle terminal configured to transmit electric power of the sub battery to the main battery of the earbud; and a second cradle terminal for sensing whether the earbud is coupled thereto, wherein the cradle controller is configured to supply the electric power of the sub battery to the main battery via the first cradle terminal when the second cradle terminal senses the coupling of the earbud thereto, wherein the second cradle terminal is configured to transmit event information about an event received via the wireless communication unit of the earbud, and wherein the cradle is configured to notify a user of the event information.

* * * * *